United States Patent [19]

Goncalves

[11] 4,095,725

[45] Jun. 20, 1978

[54] ONE-PIECE PUSHBUTTON DISPENSING CAP FOR PRESSURIZED CONTAINER

[75] Inventor: Antonin L. Goncalves, Groslay, France

[73] Assignee: L'Oreal, Paris, France

[21] Appl. No.: 749,373

[22] Filed: Dec. 10, 1976

[30] Foreign Application Priority Data

Jan. 14, 1976 France ..... 76 00826

[51] Int. Cl.[2] ..... B65D 83/14

[52] U.S. Cl. ..... 222/153; 220/85 P; 220/266; 222/402.13; 251/353

[58] Field of Search ..... 222/153, 182, 402.13, 222/402.15, 562, 570, 402.1, 402.24; 215/250, 251, 253; 220/85 P, 265, 266; 251/349, 353, 354; D9/258

[56] References Cited

U.S. PATENT DOCUMENTS

| | | | |
|---|---|---|---|
| 3,223,287 | 12/1965 | Sagarin | 222/402.13 X |
| 3,225,966 | 12/1965 | Sagarin | 215/253 X |
| 3,272,394 | 9/1966 | Sagarin | 222/541 X |
| 3,539,078 | 11/1970 | Venus | 222/153 |
| 3,744,682 | 7/1973 | Blank | 222/402.13 X |

*Primary Examiner*—Robert B. Reeves
*Assistant Examiner*—Fred A. Silverberg
*Attorney, Agent, or Firm*—Brisebois & Kruger

[57] ABSTRACT

One-piece, pushbutton dispensing cap for pressurized containers comprises a pushbutton mounted in a recess in said cap and attached to the remainder of the cap by frangible connecting pins. The pushbutton is located between guide slides which guide it in translational movement axially of the cap after said frangible connecting pins have been broken by depressing the pushbutton relative to the remainder of the cap.

14 Claims, 6 Drawing Figures

ONE-PIECE PUSHBUTTON DISPENSING CAP FOR PRESSURIZED CONTAINER

SUMMARY OF THE INVENTION

The present invention relates to a dispensing cap of the pushbutton type made in a single piece and adapted for use on pressurized containers of the aerosol bomb type.

Pressurized containers comprise a chamber holding the product to be dispensed and the pressurizing fluid, said chamber being equipped with a dispensing valve on which the user presses when he wants to dispense the product stored. The valve may be actuated by means of a dispensing cap which is associated with the container and which comprises a substantially cyclindrical peripheral jacket in alignment with the exterior of the chamber, as well as a movable part adapted to act on the outlet valve. The movable part of the dispensing cap may comprise at its upper end a tongue for opening and closing the valve and at its lower end a substantially L-shaped duct the axial arm of which fits onto the outlet of the valve and the radial arm of which conducts the dispensed product to a dispensing orifice at the outer lateral wall of the cap.

It is also known that it is advantageous, in order to reduce the cost of manufacture, to make the assembly (peripheral jacket - movable part) constituting the dispensing cap in a single molded piece. Among the caps made in this manner certain ones have the characteristic of comprising a hinge zone which is produced by molding near the dispensing orifice and which connects the stationary peripheral jacket to the movable part.

Moreover, this type of cap has, in general, an inner skirt fixed to the peripheral jacket, said skirt comprising means such as pins or a continuous rib permitting the cap to be snap-fitted over the rib formed when the valve-carrying cover is crimped to the pressurized container.

This type of cap has a first disadvantage inherent in its construction, this disadvantage being due to the fact that the pushbutton moves pivotally about its hinge, even though this movement must produce a translation of the means for opening the valve and thus causing the dispensing of the stored product. It is clear that such a method for opening the valve is not very logical and that the movable part of the cap, when it is actuated by the user, applies to the valve transverse forces which are not along the axis of sliding of the opening means so that rapid deterioration of the valve results.

Furthermore, it is desirable to equip a dispensing cap with inviolability means immobilizing the movable part during storage, but this leads generally to an increase in the complexity of the molding and consequently to an increase in the cost.

It is the purpose of the present invention to overcome these disadvantages by providing a dispensing cap which is molded as a single piece, the movable part of which acts on the outlet of the valve but is not subjected by the user to anything other than a translational movement as the result of the elimination of the hinge system and the addition of an appropriate guide. This cap may comprise inviolability means and be molded in a single piece at low cost. According to an important characteristic of the invention the movable part of the cap, after rupture of the inviolability means, constitutes a pushbutton independent of the peripheral jacket.

It is therefore an object of the present invention to provide as a new article of manufacture a dispensing cap adapted to be attached to a pressurized container of the aerosol bomb type equipped with at least one dispensing valve, said cap comprising a peripheral jacket, which is preferably substantially cylindrical, a lateral wall of which has at least one dispensing orifice and the upper wall of which comprises an opening in which a pushbutton is at least partially received, said pushbutton comprising at its upper end a radially extending tongue and at its lower end, an L-shaped duct, the axial arm of which fits onto the outlet of the dispensing valve and the other arm of which is substantially radial and opens into the said dispensing orifice. The cap comprises two internal webs forming a guide slide for the tongue of the pushbutton, these two webs being positioned symmetrically with respect to the axis of the cap and converging in the direction of the dispensing orifice. Each web comprises a shoulder dividing it into two zones, the tongue of the pushbutton comprising at its lateral edges shoulders corresponding to those of the guide webs. The cap is characterized by the fact that the zone of each guide web which is closest to the dispensing orifice is set back with respect to the other zone and, that means are provided on the lateral edges of the tongue which project into each space between one of the lateral edges of the tongue and the corresponding guide web, said members being adapted to cooperate slidingly with the guide webs in the course of the depression of the pushbutton.

In a preferred embodiment the two guide webs extend downwardly over substantially the entire path of translation of the tongue of the pushbutton. The dispensing cap is fastened to the container with which it cooperates by means of a continuous or discontinuous annular rib provided at the lower part of the lateral wall of the peripheral jacket, said rib snap-fastening into a groove provided in the lateral surface of the container. The two guide webs extend toward the edge of the dispensing orifice where they are connected to the lateral wall of the peripheral jacket of the cap. The tongue of the pushbutton has, along its longitudinal axis and on the side opposite the dispensing orifice, a depression the width of which is substantially equal to that of the finger of the user. The lateral wall of the peripheral jacket comprises a notch formed in its upper part opposite the dispensing orifice. The axial arm of the L-shaped duct which fits onto the outlet of the valve is equipped with a centering sheath adapted to fit onto the outlet of the dispensing valve of the container. The lateral edges of the tongue comprise frangible attachments which constitute, during molding, a connection between the tongue and the zone connecting the guide webs and the upper part of the cap. It should be noted that the pushbutton is thus, during molding, attached to the peripheral jacket of the dispensing cap by means of frangible means which, during storage and before use, constitute inviolability means for a pressurized container equipped with a cap according to the invention. The frangible attachments immobilize the pushbutton with respect to the peripheral jacket and thus prevent its translation and, consequently prevent opening of the valve. However, one of the essential characteristics of the cap according to the invention is that, after rupture of the inviolability means, the pushbutton comprises no other attachment connecting it to the peripheral jacket, contrary to the case of caps made in a single piece according to the prior art.

In a first variation of the invention the members adapted to cooperate slidingly with the two guide webs during depression of the pushbutton are the attachments which constitute, during molding, the connections between the tongue of the pushbutton and the two guide webs. The attachments are pins having their points directed toward the two guide webs.

When the user wants to utilize a pressurized container carrying a cap according to this first variation of the invention, he takes the container in his hand and presses on the tongue of the pushbutton. The pins break at the level of their tips and remain connected to the lateral edges of the tongue. The pins, in the course of the translation of the pushbutton, cooperate slidingly with the two guide webs, thus limiting the friction between the pushbutton and the two guide webs. It follows that the user has no need to exert more than a light pressure on the tongue in order to slide the pushbutton and depress the means for opening the valve. Moreover, since the pushbutton, during its translation, is guided along the axis of the means for opening the valve, it follows that there is less deterioration of these parts during use than in the case of prior art devices in which the pushbutton is pivotally mounted on the peripheral jacket.

In a second embodiment of the invention, the members capable of slidingly cooperating with the two guide webs during depression of the pushbutton are bars formed on the lateral edges of the tongue and extending parallel to the axis of the cap. The bars have the general shape of a prism the section of which narrows as it approaches the guide webs. Each of the bars extends substantially the entire height of the lateral edge of the tongue. Each frangible attachment is positioned overhanging a bar, said frangible attachments being pins having their tips directed toward the webs. In this second variation it is these bars fixed to the tongue of the pushbutton which, after rupture of the inviolability attachments, cooperate slidingly with the two guide webs during depression of the pushbutton. During this movement the bars constitute slides which move along the guide webs. The movement of the pushbutton is thus perfectly centered on the sliding axis of the means for opening the dispensing valve with which the pressurized container is equipped, the cooperation of the guide webs with the bars preventing any swinging movement of the pushbutton with respect to the axis of the cap.

It should be emphasized that the dispensing caps according to the invention are of a particularly simple conception adapting them to assembly-line manufacture. Moreover, the dispensing caps are attached, in a manner known in itself, directly to their peripheral jacket, so it is not necessary to provide an inner skirt, as in the case of prior art devices molded in a single piece. This results in a substantial saving in raw materials and consequently a lower cost of manufacture.

It is also an object of the present invention to provide a new article of manufacture which consists of a pressurized container of the aerosol bomb type, said container comprising at least one dispensing valve and being characterized by the fact that said valve cooperates with a dispensing cap such as the one above described.

In order that the object of the invention may be better understood, two embodiments thereof will now be described, purely by way of illustration and example, with reference to the accompanying drawings on which:

Figure 1:
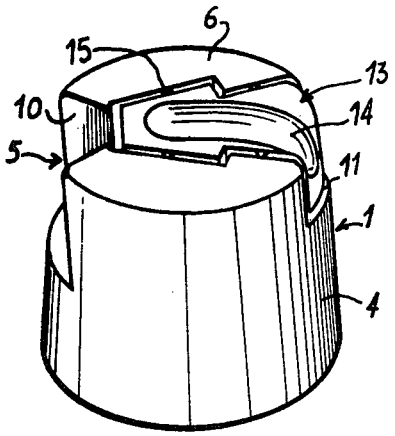
FIG. 1 is a perspective view showing a dispensing cap according to the first embodiment of the invention, in storage position.
Figure 2:
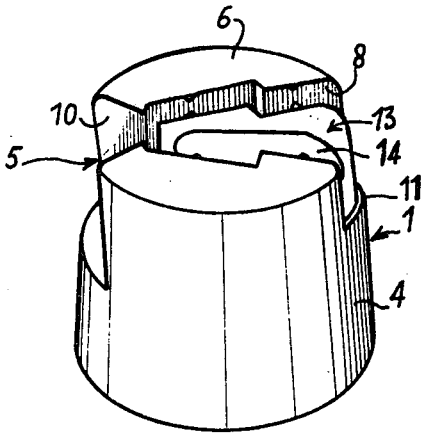
FIG. 2 is a perspective view showing the dispensing cap of FIG. 1 after rupture of the inviolability pins connecting the pushbutton to the peripheral jacket.
Figure 5:
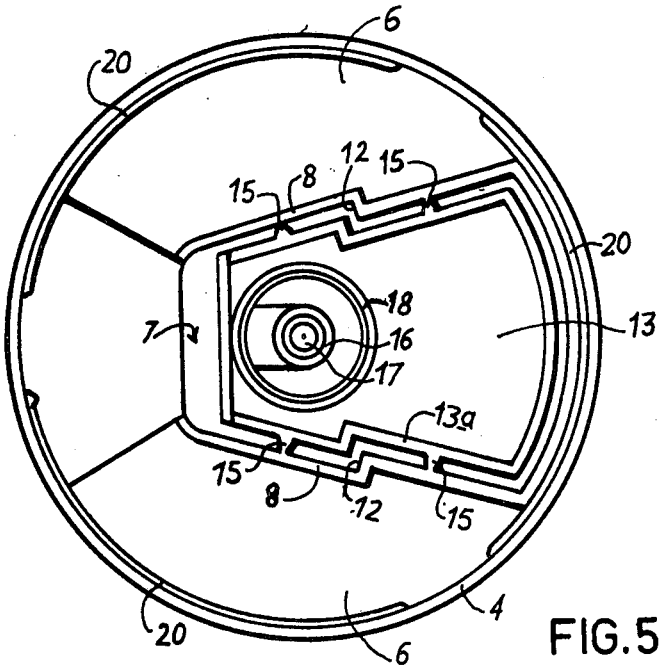
FIG. 5 is a bottom plan view of the dispensing cap of FIG. 1.
Figure 3:
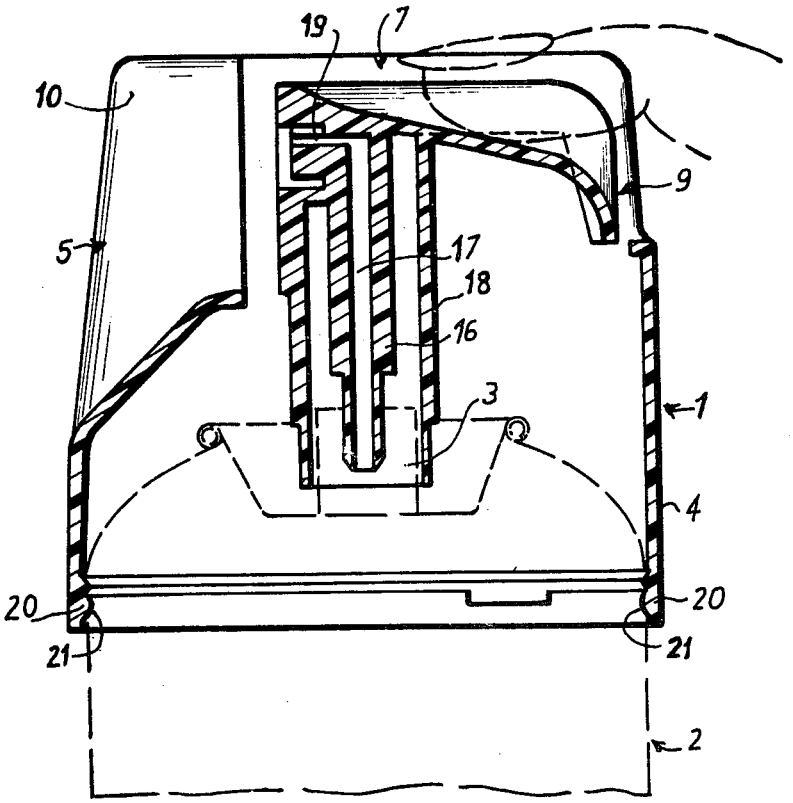
FIG. 3 is an axial section taken through the dispensing cap of FIG. 1, while the pushbutton is being depressed by the user, the associated container being shown in broken lines.
Figure 4:
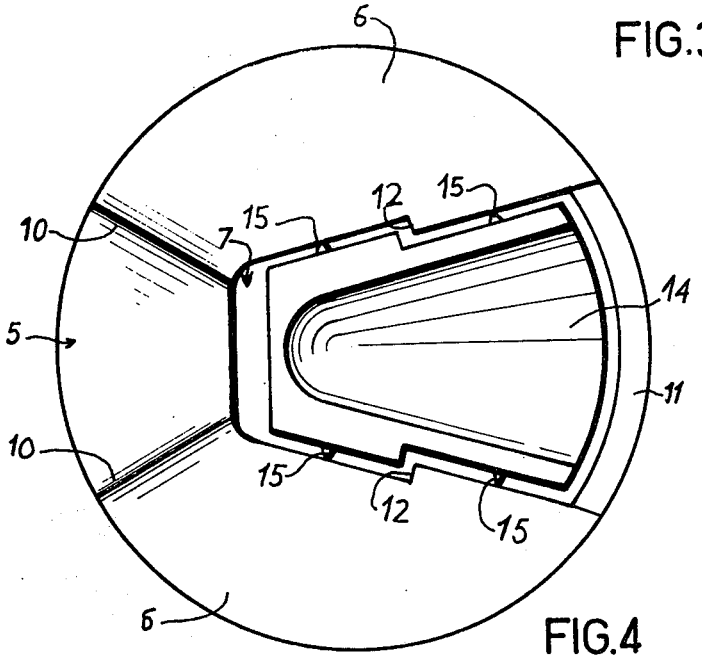
FIG. 4 is a top plan view of the dispensing cap of FIG. 1.

Referring now to FIGS. 1 to 5 it will be seen that reference numeral 1 indicates a dispensing cap according to the invention adapted to be positioned at the top of a cylindrical pressurized container 2 of the aerosol bomb type, said container comprising at its upper end a valve-carrying cover, the valve of which comprises an outlet member 3. The cap 1 is made of a single piece molded from plastic material, and comprises a peripheral substantially cylindrical jacket, the lateral wall 4 of which has near its upper end an opening 5 defining the dispensing orifice of the cap. This peripheral jacket comprises an upper wall 6 which is substantially perpendicular to the axis of the dispensing cap, the lower end of the jacket being open to permit the penetration of the upper part of the container 2. An opening 7 in alignment with the opening 5 is formed in the upper wall 6 and extends to the region of the lateral wall 4 which is diametrically opposite said opening.

The cap comprises, inside the peripheral jacket, two guide webs 8 forming a guide for a pushbutton 9, the two lateral webs being connected at right angles to the edge of the opening 7 in the upper wall. The two webs 8 are positioned symmetrically with respect to the axis of the cap and are connected to the lateral walls 10 of the opening 5 defining the dispensing orifice. The two lateral walls 10, which are also symmetrical with respect to the axis of the cap, are divergent in the direction of the outside of the peripheral jacket.

In the region diametrically opposite the recess 5, the two webs 8 define with the wall 4 of the jacket a recess 11 having a substantially angular outline. The two webs 8 also have the characteristic of being convergent in the direction of the recess 5, and each comprises in the vicinity of the axis of the cap a shoulder at right angles defining a wall 12 positioned opposite said recess. The attachment defines two zones on each web 8. The zone closest to the recess 5 is set back with respect to the other.

The pushbutton 9 consists of a tongue 13 at its upper part, which tongue extends radially into the opening 7 and serves to control the opening or closing of the valve. The tongue 13 is formed during molding substantially in alignment with the upper wall 6 of the cap. This tongue, which is capable of cooperating slidingly with the two webs 8, has on its inside a peripheral rib 13*a* defining with the two webs 8 and the corresponding zone of the wall 4 a space of uniform width. The tongue 13 thus comprises lateral edges converging toward the recess 5, each edge comprising a shoulder positioned opposite the shoulder of the associated guide web 8. To facilitate the control of the dispensing valve the tongue of the pushbutton advantageously has a depression 14 provided therein to receive the finger of the user and the recess 11 extends downwardly for substantially the full zone of translation of the tongue 13 of the pushbutton.

In each space between the lateral webs 8 and the tongue 13 are two pins 15 formed by molding. These are connected during storage and before dispensing to the pushbutton 9 and to the peripheral jacket of the cap. The pins 15 are positioned substantially in the plane of the upper wall 6 of the cap, the upper surface of the tongue 13 also lying in the same plane in the vicinity of the regions which carry the pins 15. The pins 15 constitute inviolability members for the pressurized container and are adapted to be broken by the user when he exerts sufficient pressure on the tongue 13 of the pushbutton 9. The four pins 15 have their tips directed toward the lateral webs 8 and, for this reason, at the moment of use, the pins are broken in their zone of least resistance, that is to say, substantially in alignment with the webs 8. The parts of the pins remaining on the tongue 13 constitute sliding contact members cooperating with the webs 8 in the course of the depression of the pushbutton 9.

The pushbutton 9 comprises, moreover, a central duct 16 provided with an axial passage 17 the axis of which is the same as that of the cap. The axial duct 16 is inside a sheath 18 adapted to seat on the outlet member 3 of the dispensing valve of the container. A duct 19 at right angles to the axial passage 17 of the duct 16 constitutes an extension of this axial duct and opens into the dispensing orifice of the cap defined by the recess 5 formed in the wall of the jacket.

In order to mount it on the lower part of a pressurized container 2, the cap 1 has at its lower end attachment means positioned on the inner surface of the lateral wall 4 of the jacket. This attachment means consists of a discontinuous annular sheath 20 lying in a plane substantially perpendicular to the axis of the cap. The cap is mounted on the container 2 by snap-fitting the annular discontinuous sheath 20 into a preformed neck 21 provided on the lateral wall of the container. The axial duct 16 engages the outlet member 3 of the valve which is seated in the lower part of the sheath 18, thus centering the pushbutton 9 with respect to the outlet member 3 of the dispensing valve. When the user wants to utilize a pressurized container comprising a dispensing cap according to the invention, he must break the pins 15 which form the inviolability devices of the container and which immobolize the pushbutton with respect to the peripheral jacket of the cap. This operation may be carried out by any appropriate means, for example by exerting a relatively high pressure on the pushbutton 9. It should be noted that, at this moment, the pushbutton 9 is entirely released, that is to say, it is no longer in any way attached to the peripheral jacket of the cap. In order to proceed to the dispensing of the stored product the user takes the container in the region of its dispensing cap in his hand and with a finger he presses on the pushbutton 9. This pressure causes translation of the pushbutton between the two guide webs 8 and consequently the depression of the outlet tube 3 of the valve. The product is dispensed to the extent that the pressure of the finger of the user on the pushbutton 9 is maintained. During this movement the tongue 13 is laterally guided by the two webs 8. It is held in position, on the one hand, by reason of the convergence of the webs 8 which prevent displacement toward the dispensing orifice and, on the other hand, due to the shoulders 12 which prevent displacement toward the notch 11. Since the pins 15 cooperate slidingly with the webs 8 the friction of the pushbutton 9 with respect to these guide slides is limited, and for this reason the user need exert only a feeble pressure on the pushbutton 9 to cause dispensing of the stored product. Since the pushbutton 9, in the course of its translation, is guided exactly along the axis of the outlet tube 3, the pressure exerted by the user generates forces which are along the sliding axis of the outlet tube 3 so that the dispensing valve cannot be damaged in the course of multiple dispensing operations by the user.

Figure 6:
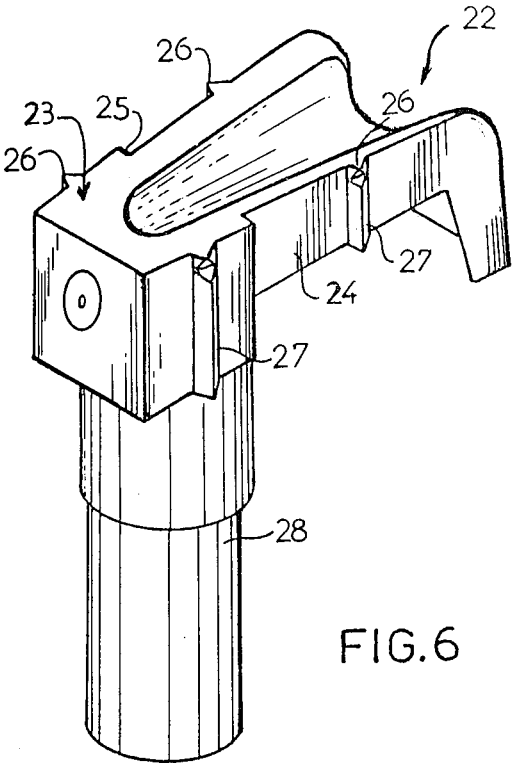
FIG. 6 is a perspective view showing the pushbutton of a cap according to a second embodiment of the invention in which bars fixed to the lateral edges of the pushbutton cooperate slidingly with guide webs fixed to the peripheral jacket.

Referring now to FIG. 6, it will be seen that this shows a pushbutton 22 analogous to the one previously described except for the fact that each of the lateral edges of the tongue is provided with two bars which are adapted to slidingly cooperate with the two guide webs fixed to the peripheral jacket on the cap. The components making up the stationary part of the cap associated with this pushbutton, to wit, the cylindrical jacket provided with its two guide webs, is identical to those already described in the embodiment of FIGS. 1 to 5 and therefore have not been illustrated. All the components making up the stationary part of this cap are thus identical to those on FIGS. 1 to 5 and have been given the same reference numerals in the following description.

The pushbutton, identified by reference numeral 22, is provided with a tongue 23 extending radially inside the opening formed in the upper wall 6. This tongue has, toward the inside of the cap, a peripheral skirt delimiting, with the two guide webs 8, a space of uniform width. For this reason the tongue 23 has two lateral sides 24 which converge toward the recess 5 in the cavity and each comprise a shoulder 25 positioned opposite the shoulder 12 of the associated guide web. The two lateral sides 24 have a wall height substantially identical to that of the guide webs 8. In each space between the guide webs and the lateral sides 24 of the tongue are two pins 26 constituting the inviolability attachments which connect the pushbutton 22 and the peripheral jacket during storage and before distribution. The webs 26 are positioned substantially in the plane of the upper wall 6 of the cap and in the plane of the upper surface of said tongue. The four pins 26 have their tips pointed toward the lateral webs 8. They break in their zone of least resistance, that is to say, in alignment with the webs 8.

On each of the lateral sides 24 of the tongue 23 are bars 27 which extend parallel to the axis of the pushbutton and which project into the space which separates the lateral sides of the two guide webs 8. Each of the bars 27 has the general shape of a prism having a triangular section, the edge of which parallel to the axis of the cap bears substantially against the walls of the webs 8. Each of the bars is, in this embodiment, positioned in alignment with a pin 26 which overhangs it, and extends substantially for the full height of each lateral side 24.

The pushbutton 22 comprises a centering sleeve 28 inside which is an axial duct adapted to be seated on the outlet member of the dispensing valve of the container. The axial duct is connected to a duct at right angles thereto which opens into the dispensing orifice of the cap defined by the recess 5 formed in the wall of the jacket. At the moment a pressurized container equipped with such a cap is placed in use and after rupture of the pins 26 which attach the pushbutton to the peripheral jacket, bars 27 conjointly with the pins 26 cooperate slidingly with the guide webs during depression of the pushbutton. It will be appeciated that the cooperation of the bars 27 with the two guide webs makes it possible to effectively center the movement of the pushbutton on which the user presses along the axis of sliding of the outlet tube of the valve by preventing any swinging movement of the pushbutton 22 with respect to the axis of the cap. It follows that the dispensing valve will not be damaged and that operation of such a cap is particularly sure and easy.

It should be emphasized that the dispensing caps according to the invention are of a particularly simple construction and may thus be manufactured at low cost. They are molded from a single piece, the attachment of the cap to the container is made directly by the lateral wall of the peripheral jacket, the inner skirt provided in certain analogous devices is eliminated, and one thus obtains a minimum weight, that is to say, a savings in raw material.

It will of course be understood that the embodiments which have been described have been given purely by way of illustration and example and may be modified as to detail without thereby departing from the basic principles of the invention.

What is claimed is:

1. A dispensing cap attachable to a pressurized container of the aerosol bomb type equipped with at least one dispensing valve, said cap comprising a peripheral jacket having a lateral wall which defines at least one dispensing orifice and an upper wall having an opening, a pushbutton at least partially received in said opening, said pushbutton comprising at its upper part a raidally extending tongue and in its lower part a right-angled duct one axial arm of which fits the outlet of the dispensing valve and the other arm of which is substantially radial and opens into said dispensing orifice, two internal guide webs acting as cooperating guide slides for the tongue of the pushbutton, said webs being symmetrically positioned with respect to the axis of the cap, convergent in the direction of the dispensing orifice, and each comprising a guide shoulder dividing it into two zones, the tongue of the pushbutton comprising on its lateral walls and between its ends, a shoulder corresponding to the guide shoulders of the guide webs, the improvement according to which:

the zone of each guide web which is closest to the dispensing orifice is set back with respect to the other zone, and edges of the lateral walls of the tongue are provided with members projecting into each space between one of the lateral walls of the tongue and the corresponding guide webs, said members being adapted to slidingly cooperate with the guide slides during depression of the pushbutton, said pushbutton having an exposed end portion extending to a location closely adjacent to a side of the peripheral jacket opposite the said at least one dispensing opening, and said axial arm of the duct being offset with respect to said end portion;

said shoulders on the lateral wall of the tongue and said guide shoulders on said jacket cooperating with each other to guide the pushbutton axially of the valve and to prevent tilting of the pushbutton toward its exposed end upon application of a force near the exposed end which tends to tilt the pushbutton with respect to the valve.

2. Cap as claimed in claim 1 in which the two guide webs extend downwardly for substantially the full path of travel of the tongue of the pushbutton.

3. Cap as claimed in claim 1 comprising means for attaching it to a container with which it cooperates, said means consisting of an annular sleeve at the lower part of the lateral wall of the peripheral jacket, said sleeve being a snap fit into a groove in a lateral surface of the container.

4. Cap according to claim 1 in which the two guide webs extend toward the edge of the dispensing orifice and are connected to the lateral wall of the peripheral jacket of the cap.

5. Cap according to claim 1 in which the tongue of the pushbutton has along its longitudinal axis on the side opposite the dispensing orifice, a depression the width of which is substantially equal to that of the finger of the user.

6. Cap according to claim 1 in which the lateral wall of the peripheral jacket comprises a recess formed in its upper part opposite the dispensing orifice.

7. Cap as claimed in claim 1 in which the axial arm of the duct which fits the outlet of the valve is equipped with a centering sleeve seated on the outlet member of the dispensing valve.

8. Cap according to claim 1 in which the lateral edges of the tongue comprise rupturable attachments which constitute during molding a connection between the tongue and the connecting zone between the guide web and the lateral wall of the cap.

9. Cap as claimed in claim 1 in which the members capable of slidingly cooperating with the two guide webs during depression of the pushbutton are attachments which constitute during molding a connection between the tongue of the pushbutton and the guide slides.

10. Cap as claimed in claim 9 in which the attachments are pins having their points directed toward the two guide webs.

11. Cap as claimed in claim 1 in which the members adapted to slidingly cooperate with the two guide webs during depression of the pushbutton are bars formed on the lateral edges of the tongue and extending parallel to the axis of the cap.

12. Cap according to claim 11 in which the bars have a generally prismatic form and in which the section of the prism narrows in the direction of the guide fins.

13. Cap as claimed in claim 11 in which each of the bars extends substantially the full height of the lateral sides of the tongue.

14. Cap according to claim 11 in which a frangible attachment overhangs each bar, said frangible attachments being pins having their points directed toward the webs.

* * * * *